US007568719B2

(12) United States Patent
Sauter

(10) Patent No.: US 7,568,719 B2
(45) Date of Patent: Aug. 4, 2009

(54) SNOWBOARD BINDING SYSTEM HAVING AUTOMATIC TOE STRAP

(75) Inventor: Thomas M. Sauter, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 200 days.

(21) Appl. No.: 10/714,510

(22) Filed: Nov. 14, 2003

(65) Prior Publication Data

US 2005/0104330 A1 May 19, 2005

(51) Int. Cl.
*A63C 9/00* (2006.01)
*A63C 9/24* (2006.01)

(52) U.S. Cl. ..... 280/619; 280/634

(58) Field of Classification Search ..... 280/613, 280/619, 622, 623, 624, 633, 634, 14.21, 280/14.22, 14.24
See application file for complete search history.

(56) References Cited

U.S. PATENT DOCUMENTS 2,590,097 A 3/1952 Goodman
4,060,256 A * 11/1977 Collombin et al. ..... 280/613
4,142,735 A * 3/1979 Biermann et al. ..... 280/618
4,949,479 A * 8/1990 Ottieri ..... 36/117.3
5,556,123 A * 9/1996 Fournier ..... 280/607
5,577,756 A 11/1996 Caron
5,692,765 A * 12/1997 Laughlin ..... 280/619
5,758,895 A * 6/1998 Bumgarner ..... 280/607
5,971,423 A 10/1999 Hansen et al.
6,003,893 A * 12/1999 Hansen ..... 280/624
6,056,300 A 5/2000 Carpenter et al.
6,065,770 A * 5/2000 Hansen et al. ..... 280/617
6,224,070 B1 5/2001 Carpenter et al.
6,270,109 B1 8/2001 Turner et al.
6,293,566 B1 9/2001 Carpenter et al.
6,416,074 B1 7/2002 Maravetz et al.
6,488,290 B2 12/2002 Carpenter et al.
6,554,295 B2 4/2003 Rittmeyer
6,938,913 B2 * 9/2005 Elkington ..... 280/607
6,955,362 B2 * 10/2005 Bazzi ..... 280/14.22

(Continued)

FOREIGN PATENT DOCUMENTS

CH 694631 A5 * 5/2005

(Continued)

OTHER PUBLICATIONS

Notification of Reason(s) for Refusal in related JP Application No. 2006-539768, mailed Mar. 3, 2009.

(Continued)

*Primary Examiner*—Frank B Vanaman
(74) *Attorney, Agent, or Firm*—Christensen O'Connor Johnson Kindness PLLC

(57) ABSTRACT

The present invention is related to a binding that can be used for securing a boot to a snowboard. The binding includes a baseplate, a toe strap, an ankle strap, a strap fastener for the toe or ankle strap, and a movable linkage that connects the toe strap to the ankle strap, such that when the fastener is operated, travel of the linkage is produced, and such travel can secure the strap that is not directly tied to the strap fastener. The invention provides for the securement of two individual straps against a snowboard boot with the operation of a single strap fastener.

38 Claims, 9 Drawing Sheets

U.S. PATENT DOCUMENTS

| | | | | |
|---|---|---|---|---|
| 2001/0009320 | A1 * | 7/2001 | Couderc et al. | 280/14.24 |
| 2001/0052688 | A1 | 12/2001 | Carpenter et al. | |
| 2004/0061311 | A1 * | 4/2004 | De Bortoli et al. | 280/623 |

FOREIGN PATENT DOCUMENTS

| | | | |
|---|---|---|---|
| EP | 0 836 869 | A2 | 4/1998 |
| FR | 2 840 224 | A1 | 12/2003 |
| WO | WO 97/31687 | A1 | 9/1997 |

OTHER PUBLICATIONS

Amendment and Argument (Remarks) filed in related JP Application No. 2006-539768, submitted May 20, 2009.

Automated English translation of prior citation EP 086869 (Bratsch, published Apr. 22, 1998), originally cited by applicant on Feb. 14, 2006, from espacenet.com, <http://epo.world.lingo.com/wl/epo/epo.html?SEED=RP0836869&SEED FORMAT=e&ACTION . . . > [retrieved Apr. 2, 2009], 4 pages.

* cited by examiner

SNOWBOARD BINDING SYSTEM HAVING AUTOMATIC TOE STRAP

FIELD OF THE INVENTION

The present invention is related to boot binding systems, and namely, to a two-strap binding system for snowboard boots having automated toe strap tightening during tightening of the ankle strap.

BACKGROUND OF THE INVENTION

One type of conventional snowboard binding system utilizes two straps for securing the snowboard boot to the snowboard. One strap is for securing the toe portion of the boot and the second strap is for securing the ankle portion of the boot. This type of boot binding system is preferred by snowboarders who engage in free-style snowboarding. The two-strap binding systems are preferred because two-strap binding systems provide comfort, a high degree of maneuverability, and lateral flexibility. A conventional two-strap binding system has one end of both of the toe and ankle strap held fast to the snowboard binding on either the lateral or the medial side so that the other end can pass over the toe or instep portion of the boot and be connected to a fastening mechanism on the opposite side of the binding. A conventional two-strap binding system, therefore, requires that each strap be individually fastened to secure the boot to the snowboard. Likewise, the two straps need to be individually unfastened to release the boot from the snowboard. The strap fastening and unfastening motions become tedious, especially in preparation before going on the ski lift and after leaving the ski lift.

Some have sought to solve the problem by providing "step-in" binding systems. Step-in binding systems typically have dogs, clasps, or pegs on the upper surface of the binding baseplate that interlock with matching receptacles on the sole of a specialized boot. Step-in binding systems, therefore, are required to be used only with a specialized boot made specifically for the step-in binding. Step-in bindings, however, do not provide the feel, comfort, and control of the conventional two-strap bindings Accordingly, there is a need to provide a two-strap binding system without some of the disadvantages of conventional two-strap binding systems, but having the feel, comfort, and control of a two-strap binding.

SUMMARY OF THE INVENTION

The present invention is related to a binding that can be used for securing a boot to a snowboard. The binding includes a baseplate, a toe strap, an ankle strap, a strap fastener for the toe or ankle strap, and a movable linkage that connects the toe strap to the ankle strap, such that when the fastener is operated, travel of the linkage is produced, and such travel can secure the strap that is not directly connected to the strap fastener. The invention provides for the securement of two individual straps against a snowboard boot with the operation of a single strap fastener.

The movable linkage can include one or more cables arranged in various configurations. At least one cable is connected to one movable end of the toe strap and the same or different cable is connected to one movable end of the ankle strap, such that the toe strap cable and ankle strap cable are connected to one another, and therefore, movement of one strap causes movement of the other strap. In some embodiments, two cables can connect with the toe strap, one at each side, such that both ends of the toe strap can travel. In some embodiments, there can be two or more cables that loop around with the toe strap. In some embodiments, one end of the toe strap is held fast to the baseplate, and the end that is opposite to the end that is held fast is connected to a cable that is allowed to travel. In some embodiments utilizing a single toe strap cable, the same cable is directly connected to the ankle strap. In some embodiments utilizing two toe strap cables, with a cable at each side of the toe strap, the cables merge into a single cable which is then connected to the ankle strap. In some embodiments utilizing two toe strap cables, with a cable at each side of the toe strap, the two cables connect directly to the ankle strap. In some embodiments, a cable can be looped around a circular guide mounted to the ankle strap, and then the cable is held fast to the baseplate to multiply the amount of travel on the cable that is connected to the toe strap. In some embodiments, a cable may have a stop block held fast to the cable that will provide a predetermined amount of travel of the cable connected to the toe strap, by abutting against a corresponding stop feature on the baseplate. Once the predetermined amount of cable travel is achieved, the operation of the strap fastener cannot further cause tension beyond the predetermined amount, but can continue to tension the strap that is not limited by the cable stop. In some embodiments, a spring can be provided on the cable that is compressed during cable travel, and the release of the tension on the cable is assisted by the release of the compressed coiled spring to facilitate the release of the boot from the binding. In some embodiments, the strap fastener can include various components. Some of the strap fastener components can be mounted on the strap, and some of the fastener components can be mounted to the baseplate. For example, utilizing a ratchet, pawl, and strap ladder fastener, the ratchet and pawl can be mounted to the ankle strap and the strap ladder can be connected to the baseplate. In some embodiments, the strap ladder can be indirectly connected to the baseplate with one of the movable cables as well, such as the cable connected to one side of the toe strap.

The snowboard binding system according to the present invention is in direct contrast to the conventional two-strap binding systems requiring one fastening mechanism to tighten and loosen the toe strap and a second fastening mechanism to tighten and loosen the ankle strap. According to the present invention, only a single fastening and loosening operation on a single strap (either the toe or ankle strap) is performed manually, the second strap (either the toe or ankle strap) is automated to fasten and/or loosen with the fastening and/or loosening with the manually operated strap fastener. The snowboard binding system according to the present invention can accommodate boots of all makes and models and is not restricted to only a single model boot as are the "step-in" binding systems. The binding system according to the present invention retains the advantages of feel, comfort, and control associated with two-strap binding systems, and has further related advantages, such as requiring less time and effort to fasten and unfasten two individual straps. Overall, the strap fastening operation is simplified and made more efficient by the binding system of the invention.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
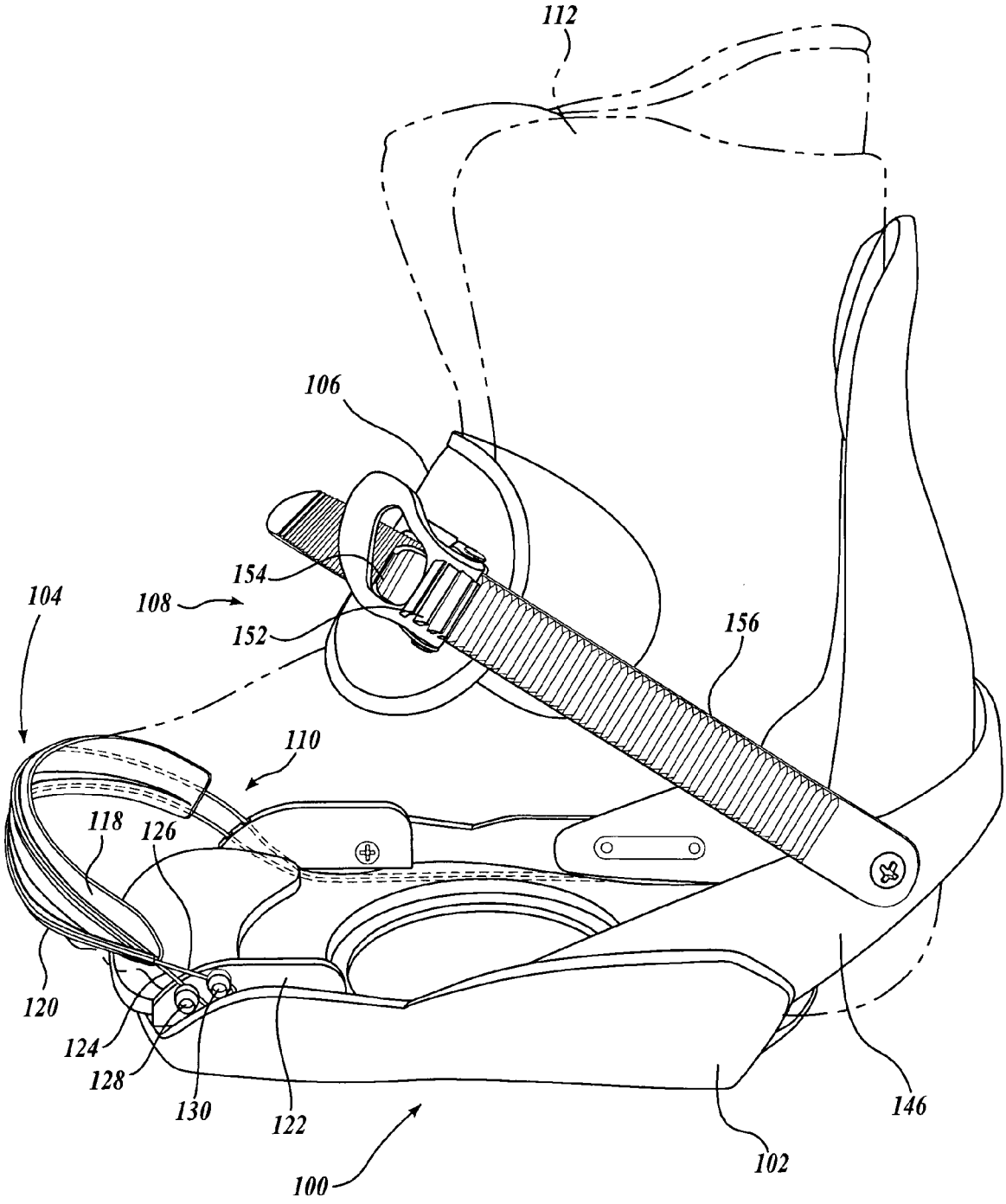
FIG. 1 is an illustration of one embodiment of a binding system according to the present invention, the outline of a boot is shown in phantom.

Referring to FIG. 1, a two-strap snowboard binding system 100 according to the present invention is illustrated. The binding system 100 is configured to be mounted on a snowboard or other gliding board for traversing surfaces. The binding system 100 includes a baseplate 102 having a heel plate 146, a toe strap 104, an ankle strap 106, an ankle strap fastener 108, and a movable linkage 110 connecting the toe strap 104 to the ankle strap 106. In this embodiment, the linkage 110 includes cables 124, 126, and 138 that connect the ankle strap 106 to the toe strap 104, such that when the ankle strap 106 is caused to be secured against the instep portion of boot 112 with the ankle strap fastener 108, the cable attached to the ankle strap 106 causes securement of the toe strap 104 against the toe portion of the boot 112. Operation of the ankle strap fastener 108 thus secures both the ankle strap 106 against the instep portion of the boot 112 and the toe strap 104 against the toe portion of the boot. As used herein, "toe portion of the boot" or "toe portion" refers to the frontal area of the boot that covers the phalanges, and partially the metatarsal bones of the foot. The toe portion is adjacent to the instep portion of the boot. "Instep portion of the boot" or "instep portion" refers to the area of the boot that is not the toe portion, and includes the part of the boot that covers the remaining metatarsal and tarsal bones of the foot not covered by the toe portion, and may also include the bones of the leg. Various configurations of linkages are possible to connect the ankle strap to the toe strap in a movable relationship that can be accomplished with the use of cables. Metal cables are preferred for their flexibility, strength and cost, but other mechanical linkages not including cables may be configured to link the ankle strap to the toe strap.

The toe strap 104 as seen in FIG. 1 is a bifurcated toe strap, meaning that two segments comprise the toe strap 104. One segment 118 is secured against the toe portion of the boot at an angle of about 45° with the horizontal surface. In this configuration, both a vertical and a horizontal holding component are imparted to the boot 112 (shown in phantom). The vertical component prevents lifting of the toe portion of the boot off the binding, while the horizontal component prevents forward movement of the boot. The second segment 120 of the bifurcated toe strap 104 is mainly there to provide a horizontal holding component, preventing forward movement of the boot 112.

The baseplate 102 is approximately symmetrical with respect to the longitudinal axis, which divides the baseplate 102, and also the binding 100 into two halves, which are the lateral and medial halves. Objects on the lateral half are referred to as being on the lateral side, while objects on the medial half are referred to as being on the medial side. "Lateral" as used herein when referring to objects that are for the foot, refers to the side of the foot facing outward, as compared with "medial," which is the side facing inward. The baseplate 102 includes a metal plate 122 attached to the forward portion of the baseplate 102 at the lateral side. The baseplate 102 may be made from a rigid plastic material; however, metals can also be used. As shown in FIG. 1, a first 124 and a second 126 cable are held fast to the metal plate 122. The first 124 and second 126 cable ends are anchored to the metal plate 122 by clamp-down nuts 128, and 130. The first 124 and second 126 cables are respectively stitched, or otherwise integrated, into the bifurcated toe strap segments 118 and 120 from one end to the opposite end of the segments, one cable for each segment of the bifurcated toe strap 104. The bifurcated toe strap 104 and ankle strap 106 can both be made from heavy cloth materials or other fabrics and/or flexible plastics, with foam used for padding. While the cables 124 and 126 are stitched into the toe strap segments 118, 120, the toe strap segments are allowed to slide in relation to the cables. Both the toe strap 104 and ankle strap 106 extend at least from the lateral side to the medial side, crossing the longitudinal axis that divides the binding into the lateral and medial halves. Accordingly, both the toe strap 104 and ankle strap 106 have first and second sides with ends in the lateral and medial sides of the binding.

Figure 2:
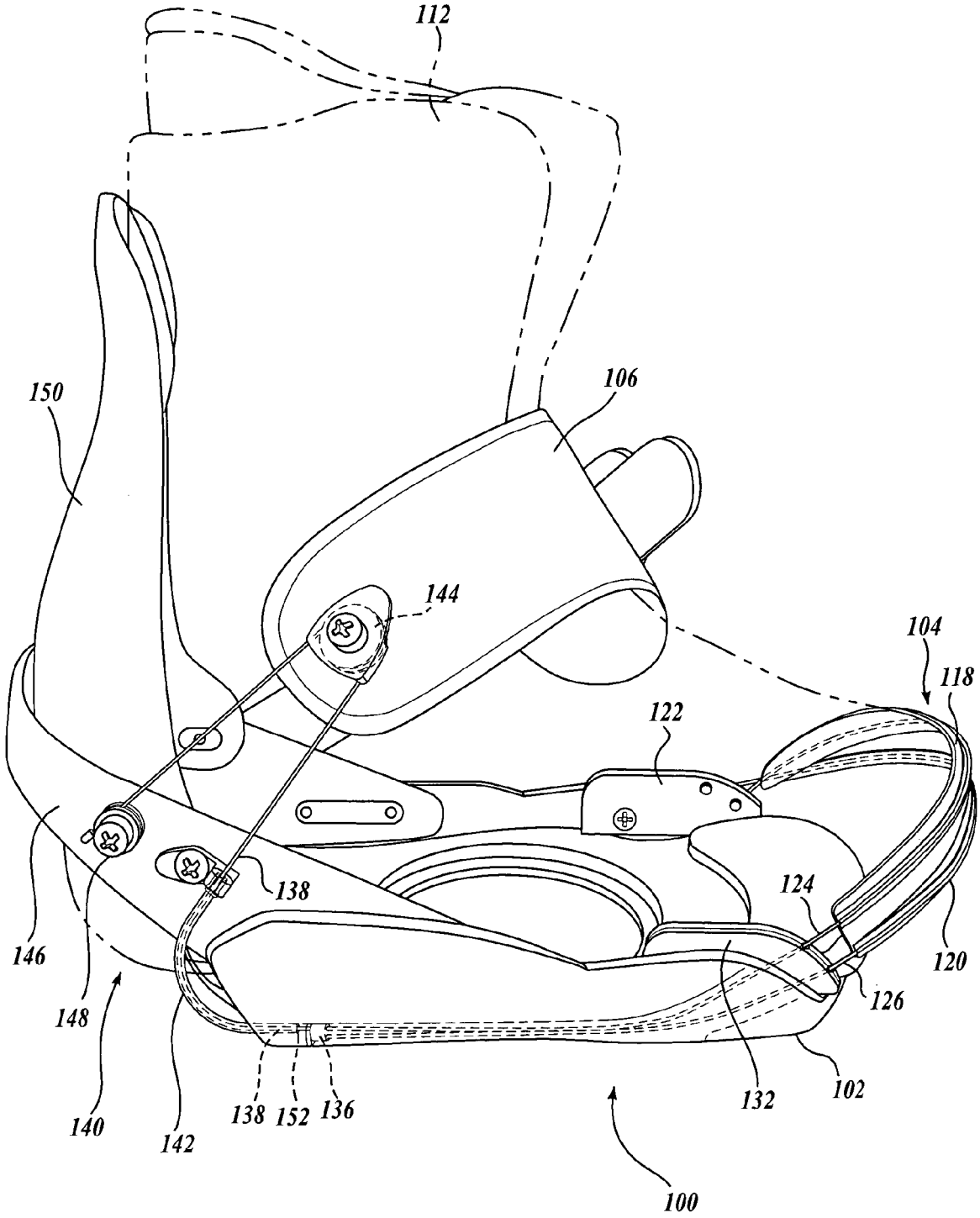
FIG. 2 is an illustration of the binding system of FIG. 1 shown from its opposite side.

Referring now to FIG. 2, the first 124 and second 126 cables are shown exiting the bifurcated toe strap segments 118, 120 at the end of the toe strap 104 that is distal to the end where the cables 124, 126 are attached to the metal plate 122, i.e., the cables 124 and 126 emerge on the medial side of the bifurcated toe strap 104. The baseplate 102 has a second metal plate 132 that is located on the side of the baseplate opposite to the first metal plate 122. The second metal plate 132 has guides for the first 124 and second 126 cables. In this instance, the second metal plate 132 has channels therein to provide passageways that guide the first 124 and second 126 cables to the underside of the baseplate 102. Thus, both the lateral and medial ends of the bifurcated toe strap 104 are connected to the baseplate 102 only via cables. 124 and 126.

Referring still to FIG. 2, the first 124 and second 126 cables are seen being routed in a channel on the underside of the baseplate 102. The first 124 and second 126 cable ends that are distal to the ends that are attached to the first metal plate 122 are both attached to a yoke 136. The yoke 136 is further attached to a third cable 138. The third cable 138 is attached on the side of the yoke 136 opposite to the side to which the first 124 and second 126 cables attach. As is readily apparent from the disclosure, causing the third cable 138 to travel any amount of distance in the direction that is toward the heel 140 of the boot 112 will cause the first 124 and second 126 cables to travel in the same direction as well, thus shortening the cables 124 and 126 that loop over the toe portion and causing the bifurcated toe strap 104 to approach the toe portion of the boot 112. When sufficient amount of tension is applied on cable 138, the cables 124 and 126, will secure the toe strap 104 against the toe portion of the boot 112, thus holding the toe portion against the baseplate 102. In addition to serving as an attachment point for the first 124, second 126, and third 138 cables, the yoke 136 provides a means to stop cable travel at a predetermined position, meaning that the respective placement of the yoke 136 can determine the amount of cable travel that is allowed, and thus determine a maximum limit of toe strap securement. For instance, in its location seen in FIG. 2, the cable 138 is allowed to travel rearwardly until the yoke 136 abuts against a structural stop feature 152 located on the baseplate underside. The cable 138 is allowed to travel up to the point where the yoke 136 abuts against the structural stop feature 152 that prevents further cable travel. For example, structural stop feature 152 can be a wall having a hole of diameter smaller than the yoke 136 that allows the cable 138 to freely pass through but prevents the yoke 136 from passing. It is to be appreciated from the disclosure that the cable travel limit is set by the placement of the yoke 136; however, in actuality, the cable travel may be halted before this limit is reached. For instance, cable travel may be halted at the point where the bifurcated toe strap is sufficiently secured against the toe portion of the boot so that any further cable travel is not without strenuous effort that makes further tightening unreasonable. Accordingly, cable travel can be halted by securement of the toe strap against the boot which can occur prior to the yoke abutting against the stop feature on the baseplate.

Referring still to FIG. 2, the third cable 138 is seen exiting the rear of the baseplate 102 and is encased within an insulator or sheath 142. The third cable 138 is routed upwards and forwards by the bent, but rigid sheath 142. The third cable 138 exits the rigid sheath 142, and is then looped over a circular guide 144 which causes a change in cable direction of about 180° from the direction which the cable 138 first entered the circular guide 144. The circular guide 144 is held fast to the ankle strap 106 at one end of the ankle strap, i.e., on the medial side. Thus, the medial side of the ankle strap 106 is connected to the baseplate 102 only via the third cable 138. The end of the third cable 138 that is distal to the end that is attached to the yoke 136 is held fast to the heel plate 146 of the baseplate 102 with clamp-down nut 148.

The heel plate 146 portion of the baseplate 102 extends from and is connected at both lateral and medial sides of the baseplate 102; therefore, providing a heel rest to prevent backward movement of the boot. A highback 150 may be connected to the heel plate 146 and baseplate 102 for additional boot support. As is readily apparent from the disclosure, pulling on the ankle strap 106, such as by fastening the ankle strap 106 around the instep portion of the boot 112, with the ankle strap 106 being connected on the medial side of the binding solely by the third cable 138, will cause travel of the third cable 138 at the end that is not held fast to the heel plate 146. Such travel of cable 138 will cause travel of cables 124, 126 to cause securement of the bifurcated toe strap 104 against the toe portion of the boot 112, by either taking up the slack in the cables until the toe strap 104 is pressing against the boot 112, or the yoke 136 has bottomed against the stop feature 152. It is also appreciated from the disclosure that once the yoke 136 has come to abut against the stop feature, the application of greater tension to cable 136 will not increase the tension on cables 124, 126, but will further serve to tension the ankle strap 106 to the instep portion of the boot 112. It should also be appreciated that the cable configuration whereby the cable 138 is looped around a guide 144 on the ankle strap 106, with the cable 138 held fast to the heel plate 146, will cause a doubling of travel of cable 138, so that every increment of travel of ankle strap 106 will double the amount of travel of cables 124, and 126.

Referring back to FIG. 1, the ankle strap 106 crosses the boot from side to side at the instep portion of the boot 112. On the lateral side, the ankle strap 106 is fastened to the binding with a fastener 108. The side of the ankle strap 106 that does not have the circular guide 144, instead has a ratchet 152 and pawl 154 on a frame mounted to that ankle strap 106 medial side. The ratchet 152 and pawl 154 are adapted to be threaded with strap ladder 156. The strap ladder 156 has one end held fast to the heel plate 146 and the opposite end can be either loose or connected to the ankle strap 106 via the ratchet 152 and pawl 154. The strap ladder 156 may be fixed to the heel plate 146 with a pin, screw, rivet or other fastener to pivot about the attachment point. The strap ladder 156 may be made from a thin length of hard rubber, or other flexible material. The surface of the strap ladder 156 facing inside, i.e., toward the boot, can be smooth, while the side facing the outside has serrated, inclined teeth, or "steps" that are configured to engage with the corresponding teeth on the ratchet 152. Operating the ratchet by repeatedly arcing the ratchet handle about its pivoting point on the frame will cause the strap ladder 156 to be incrementally engaged with the ratchet 152 and pawl 154. The pawl 154 prevents the strap ladder 156 from reversing direction, once ratcheted, by interlocking with the strap ladder steps. The pawl 154 is caused to be pivoted about a fulcrum in a slanted manner by a spring. One end of the pawl 154 is spring biased to cause the pawl 154 to fall into the steps of the strap ladder and the opposite end is configured with a release handle that when pressed pivots the pawl end away from the steps, disengaging the strap ladder 156. As can be readily appreciated from this disclosure, release of the pawl 154 from the strap ladder 156 will likewise release the tension on the ankle strap 106, cables 124, 126, 136, and toe strap 104, thereby releasing the boot 112 from the binding.

With the bifurcated toe strap 104 being connected to the baseplate 102 via movable cables 124 and 126, wherein the cables are further connected to the ankle strap 106 via the third movable cable 138, and the ankle strap 106 having a fastener 108 that causes travel of the ankle strap 106; and therefore, in accordance with the invention, operation of the ankle strap fastener 108 to cause movement and securement of the ankle strap 106 against the instep portion of the boot 112 will cause cable travel and simultaneous or nearly simultaneous securement of the bifurcated toe strap 104 against the toe portion of the boot 112. Operation of a single strap fastener will secure two discrete straps against two different portions on the boot upper surface. Unlike a conventional two-strap binding system, neither toe strap nor ankle strap of the invention requires one end to be held fast to one side of the binding to effectuate binding of the straps. In the toe and ankle straps shown in FIG. 1, at least one end of each strap is movably connected with a cable, wherein the cables that are connected to each side of each strap are also connected to one another. Unlike conventional two-strap binding systems, securement of at least one of the sides of the straps to the baseplate is effectuated via cables. If a linkage is provided interconnecting one strap with the other, only a single strap fastener mechanism is required to secure two distinct straps at two different locations on the boot.

Likewise, disengagement of the strap ladder 156 from the pawl 154 and ratchet 152 on the ankle strap 106 will not only release pressure of the ankle strap 106 from the instep portion of the boot 112, but will also result in release of the tension on the cables 124, 126, 138, and thus release of the pressure of the bifurcated toe strap 104 against the toe portion of the boot 112, thereby enabling the boot 112 to be released from the binding.

Figure 3:
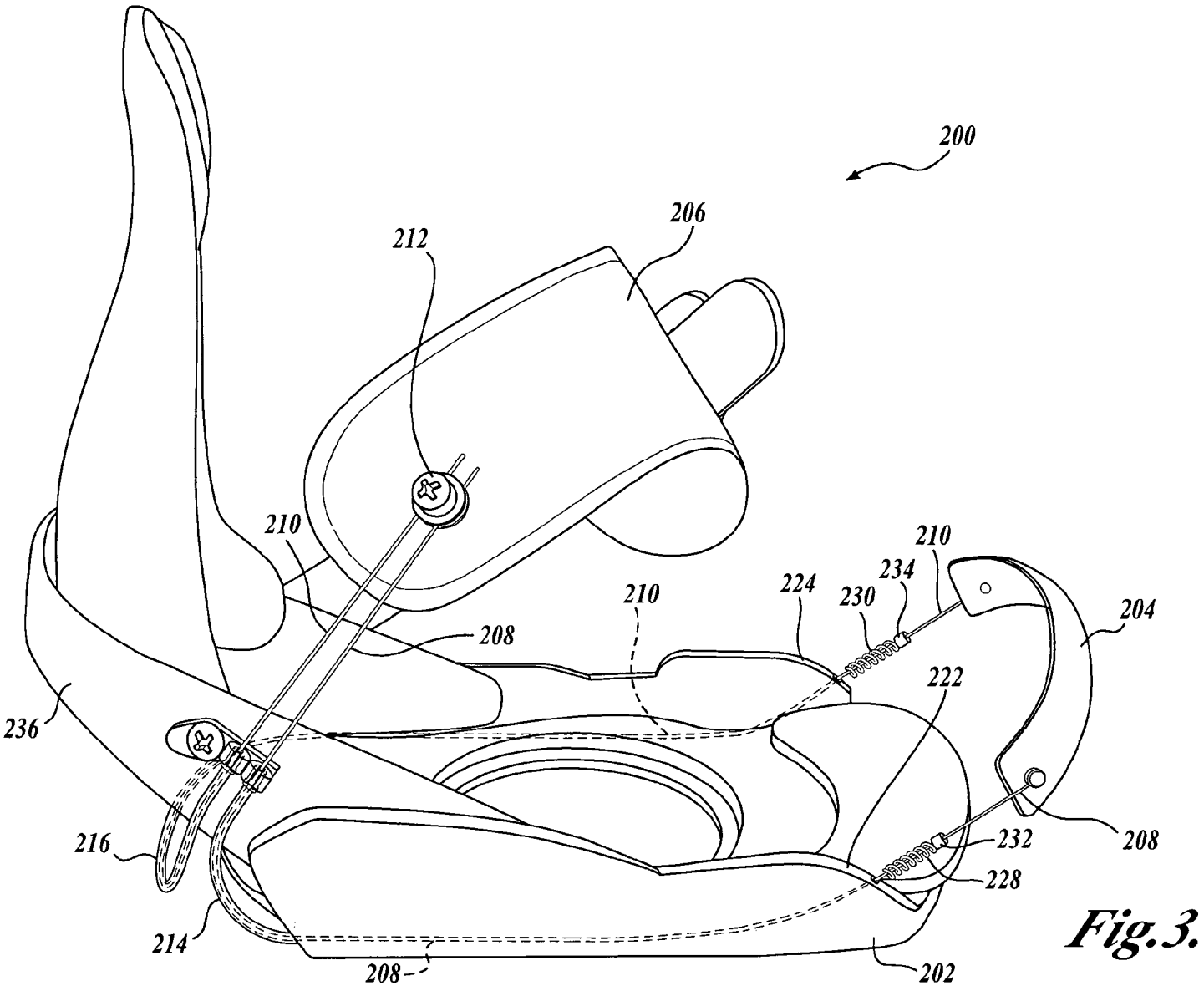
FIG. 3 is an illustration of an alternate embodiment of a binding system according to the present invention.

Referring next to FIG. 3, an alternate embodiment of a two-strap snowboard binding system 200 according to the present invention is illustrated. Like the previous embodiment, the binding system 200 includes a baseplate 202 including a heel plate 236, a toe strap 204 connected to at least one cable on one side thereof, an ankle strap 206 connected to at least one cable on one side thereof, an ankle strap fastener (not shown, but for all embodiments, the fastener may be considered similar to the fastener of FIG. 1) wherein the cables connected to the toe and ankle straps link the ankle strap 206 to the toe strap 204 in a movable fashion.

The toe strap 204 of FIG. 3 is also not directly connected to the baseplate 202, rather the toe strap 204 is connected to the baseplate 202 by a first cable 208 connected on one end thereof and by a second cable 210 connected on the second end thereof. In other words, both ends of toe strap 204 are connected to the baseplate 202 in a movable fashion relative to the baseplate 202. Therefore, the toe strap 204 is unlike conventional toe straps in that the toe strap 204 is not held fast to the baseplate 202 nor does the toe strap 204 have a discrete fastener just for securement of the toe strap 204. The first cable 208 is held fast to one end of the toe strap 204 and is routed to the ankle strap 206 through one or a plurality of baseplate guides. The first cable 208 is connected to the ankle strap 206 by clamp-down nut 212. The second cable 210 is likewise held fast to the toe strap 204 on the opposite end, and the second cable 208 is routed through guides on the baseplate 202 to the ankle strap 206 on the same side as cable 208, and also held fast to the ankle strap 206 with clamp-down nut 212. The first and the second cables 208 and 210, respectively, may be provided with sheaths 214, 216, to protect the cables from wear, or from impeding the travel of the cables. One end of the ankle strap 206 is thus connected by the cables 208 and 210 that also connect to the toe strap 204, and the opposite end of the ankle strap 206 not connected to cables 208 and 210, is free to engage with an ankle strap fastener. Therefore, the ankle strap 206 of the invention is unlike the conventional ankle straps in that the ankle strap 206 is not directly connected to the binding. In other words, the end of the ankle strap 206 that is indirectly connected to the binding is connected with cables 208, 210 that are free to travel.

As is readily apparent from the disclosure, travel of the ankle strap 206 and cables 208, 210, during securement of the ankle strap 206, will cause securement of the toe strap 204 around the toe portion of the boot; thus, effectuating automated toe strap securement with securement of the ankle strap 206. The cables 208 and 210 connecting the ankle strap 206 to the toe strap 204 may be pulled by pulling on the ankle strap 206 via the ankle strap fastener. Thus, pulling on the ankle strap 206 will pull each end of the toe strap 204 nearer to the baseplate 202, effectively securing the toe portion of a boot to the baseplate 202 and snowboard. In other embodiments described below, one end of a toe strap can be held fast to the baseplate and one end is free to travel nearer to the baseplate, i.e., so as to cause the toe strap to close about the toe portion of the boot. These embodiments are unlike the conventional toe straps in that the toe strap of the present invention does not have a distinct toe strap fastener dedicated just for the toe strap.

Cable stop blocks 232, 234 held fast to the cables 208, 210 may be provided at any location on cables 208, 210 to prevent the cables 208, 210 from traveling past a predetermined position. For example, pulling on the ankle strap 206 will pull the first 208 and second 210 cables connected to the toe strap 204 to the point where the cable stop blocks 232, 234 abut against corresponding stop features 222, 224 on the baseplate 202. At this point, any further pulling of the ankle strap 206 maintains tension on the cables 208, 210 and toe strap 204, but is ineffectual in pulling the cables 208, 210 past the predetermined position. Thus, after the predetermined amount of slack has been taken up on the cables 208, 210, the ankle strap 206 continues to be tightened about the instep portion of the boot, without additional travel of the cables 208, 210 beyond the predetermined position. Positions of cable stop blocks 232, 234 initially may be set to provide the desired amount of travel, and once set may be left at the initial position during all future use of the binding. It is to be appreciated that securement of toe trap 204 to boot may take place prematurely to stop blocks 232, 234 abutting against the stop features on baseplate 202.

In one embodiment of the binding system 200, springs 228, 230, exterior to the baseplate 202, may be provided on the cables 208 and 210, respectively, between the stop blocks 232, 234, and the baseplate stop features 222, 224. One end of the springs 228, 230 abut against the rigidly fixed stop block 232, 234 and the opposite ends of the springs 228, 230 abut against the stop features on the baseplate 202. Thus, the springs 228, 230 are compressed during pulling on the ankle strap 206 and corresponding travel of the cables 208, 210. However, compression of the springs 228, 230 is halted when the cable stop blocks 232, 234 rigidly fixed to the cables fully compress the springs 228, 230 by abutting against the cable stop features on the baseplate 202. In this manner, the cables 208, 210 become "spring-loaded" so that releasing the tension on the cables 208, 210 by undoing the ankle strap fastener will cause the toe strap 204 to be sprung away from the boot and baseplate 202 to assist in slackening of the cables 208, 210, and facilitate release of the snowboard boot from the binding system. It should be appreciated that more than one stop block can be located on each of the cables to prevent full compression of the springs. For example, a cable stop block can be placed in a location not associated with the springs which independently governs the amount of predetermined cable travel without having to rely on the spring becoming fully compressed before the cable travel is halted.

One end of the ankle strap 206 is connected to the ends of the cables 208, 210 that are distally located from the toe strap 204. This end of the ankle strap 206 is not connected to the baseplate other than through the cables 208, 210. This is in contrast to conventional two-strap binding systems that always have at least one end of every strap fixed to the binding. The second end of the ankle strap 206 is connectable and releasable from the binding with the use of an ankle strap fastener. In use, a snowboard boot can be placed so that the sole of the boot rests on the baseplate upper surface. The toe portion of the boot is positioned in proximity and below the toe strap 204, and the ankle strap 206 is made to pass over the instep portion of the boot, and the free end of the ankle strap 206 is engaged to the binding via the ankle strap fastener. At this point, both the toe strap 204 and the ankle strap 206 can be loose. The strap ladder can be inserted into the pawl and ratchet mechanism on the ankle strap 206. As the ankle strap fastener is actuated, the cables 208, 210 are pulled in the direction toward the heel of the boot. At some point, either the toe strap 204 will abut against the boot or the cable stop blocks 232, 234 that are rigidly fixed to the cables 208, 210 will abut against the corresponding cable stop features on the baseplate 202. At this point, the cables reach the end of their travel. Once the cable stop blocks 232, 234 abut against the corresponding stop features on the baseplate 202, any further operation of the ankle strap fastener serves to tighten the ankle strap 206 against the instep portion of the boot, while neither increasing nor decreasing the tension that is already placed on the toe strap 204. Thus, by operating a single ankle strap fastener, both the toe strap 204 and the ankle strap 206 are caused to be secured against the snowboard boot.

To release the snowboard boot from the binding system, the pawl is disengaged from the serrated teeth on the strap ladder. If springs are used, the springs push the toe strap away from the boot toe portion causing slackening of the cables and assist with the release of the boot from the binding system.

Figure 4:
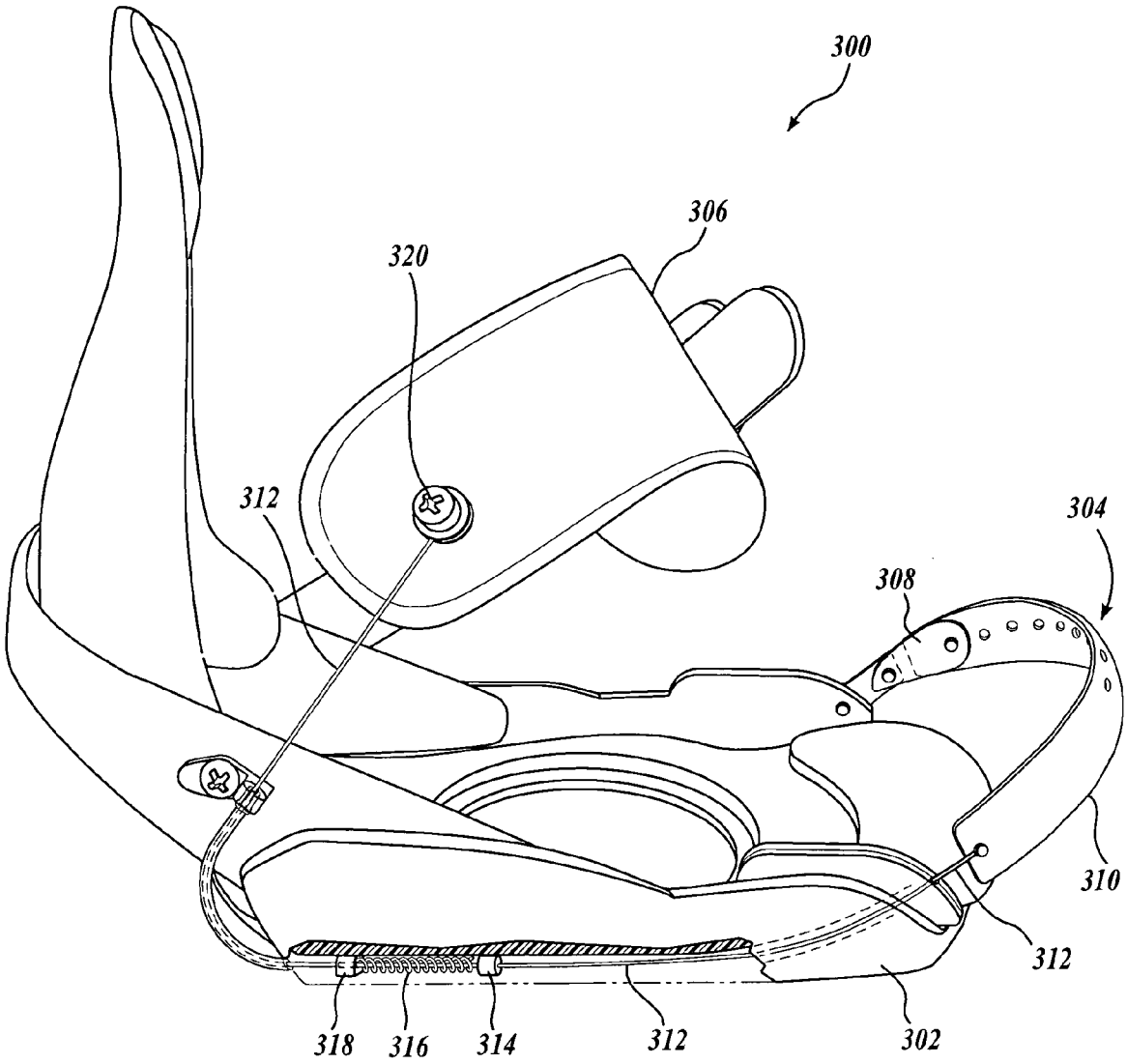
FIG. 4 is an illustration of an alternate embodiment of a binding system according to the present invention.

Referring now to FIG. 4, a third embodiment of a binding 300 is illustrated. FIG. 4 illustrates a strap/cable configuration for a baseplate 302, wherein one end of the toe strap 304 is held fast to the baseplate 302. The toe strap 304 may comprise a first 308 and second 310 portion, wherein portion 308 is fixed to the baseplate 302, and portion 310 is held fast to cable 312, and releasable and attachable to the portion 308. The overall length of the toe strap 304 is adjustable, providing a toe strap length that can be varied for different make or model boots. The length of the toe strap 304 is adjustable by, for example, releasing a screw, peg or other type fastener that connects the two portions of the toe strap and increasing the overall length and refastening the two portions of toe strap. The end of the toe strap 304 that is opposite to the end that is fixed to the baseplate 302 is connected to cable 312. Like in the previous embodiment, the cable 312 may have a cable stop block 314 that can be initially adjusted to set the predetermined amount of cable travel that is allowed. The amount of cable travel that is allowed should end in the toe strap 304 being held securely to the boot toe portion. The cable stop block 314 on the cable 312 initially can be slid forwards or backwards on the cable 312 to set the predetermined amount of travel allowed for the cable, and thus the maximum holding tension on the snowboard boot can be predetermined from the onset. Once determined, the cable stop block 314 can be fixed in position, such as by clamping with a screw (not shown), and later, if necessary, the stop block position can be changed by loosening the screw, and repositioning the stop block 314. As in the previous embodiment, a spring 316 can be provided on the cable 312 between the stop block 314 and baseplate stop feature 318. The spring 316 is configured to compress upon cable travel to the predetermined position determined by the stop block 314 on the cable 312 and the stop feature 318 on the baseplate 302. The cable 312 is further routed to the ankle strap 306 by guides positionable on the baseplate 302. The end of the cable 312 that is distal to the end of the cable 312 that is attached to the toe strap 304 is held fast to the ankle strap 306 via clamp-down nut 320. As with the previous embodiments, an ankle strap fastener is used to pull on the ankle strap 306, and by pulling on the ankle strap 306, the cable 312 is pulled, thereby causing tightening of the toe strap 304 to a snowboard boot, up to a predetermined position that is determined by the location of the stop block 314 on the cable 312 and the stop feature 318 on the baseplate 302. Once the cable stop block 314 abuts against a corresponding stop feature 318 on the baseplate 302 or the cable 312 cannot travel further because the toe strap 304 has bumped up against the boot, cable travel is halted, and further operation of the ankle strap fastener serves to tighten the ankle strap 306 to the boot instep portion while maintaining the tension on the toe strap 304. Release of the ankle strap fastener functions to release both the ankle strap 306 and the toe strap 304 from engaging the snowboard boot and the boot can thereby be released from the snowboard binding.

Figure 5:
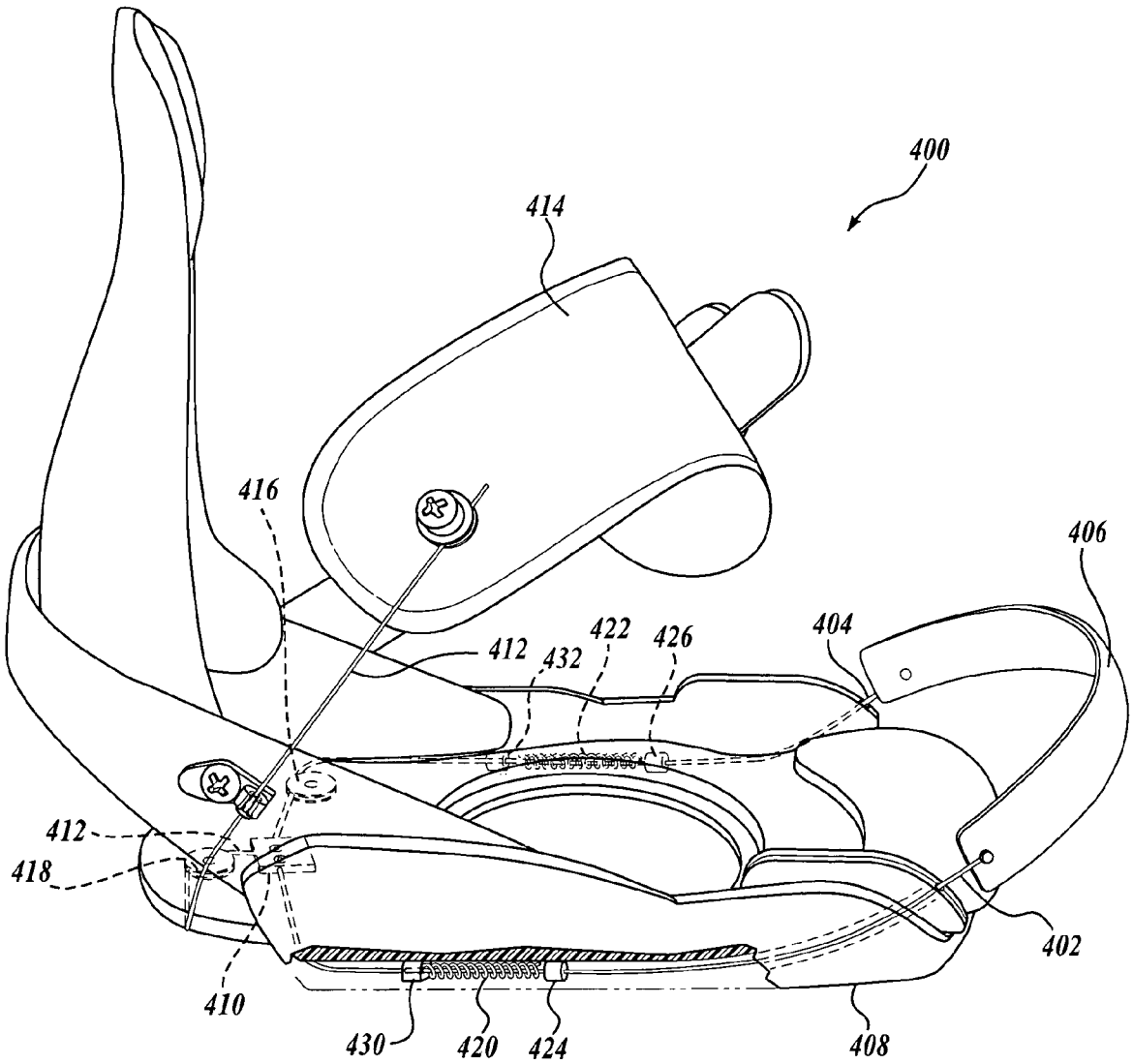
FIG. 5 is an illustration of an alternate embodiment of a binding system according to the present invention.

Referring now to FIG. 5, an alternate embodiment of a binding 400 is illustrated. In this embodiment, first 402 and second 404 cables are provided to each end of the toe strap 406 as with the embodiment represented by FIG. 3. Thus, each end of the toe strap 406 is moveable relative to the baseplate 408. The ends of the first 402 and second 404 cables that are distal to the ends of the cables that are connected to the toe strap 406 are connected to a yoke 410. The yoke 410 is further connected to cable 412, which is further connected to the ankle strap 414. Rollers 416 and 418 serve as guides in this embodiment, and can be provided at suitable locations on the baseplate 408 to facilitate pulling on the cables 404, 412 without significant friction or wear. As in the previous embodiments, operation of an ankle strap fastener will operate to take up the slack in the cables 402, 404 until the cable stop blocks 424, 426 fixed to the cables 402, 404 abut against the stop features 430, 432 on the baseplate 408 that determine the predetermined amount of tightening of the toe strap 406 against the boot toe portion, and halt cable travel. Further operation of the ankle strap fastener serves to tighten the ankle strap 414 against the instep portion of the snowboard boot because the cable 412 is prevented from further travel. As with the previous embodiment, springs 420, 422 can be positioned on the cables 402, 404 between cable stop blocks 424, 426 and stop features 430, 432 to compress during tightening of the ankle strap 414 and to assist in release of the boot from the toe strap 406, once the ankle strap fastener is disengaged.

Figure 6:
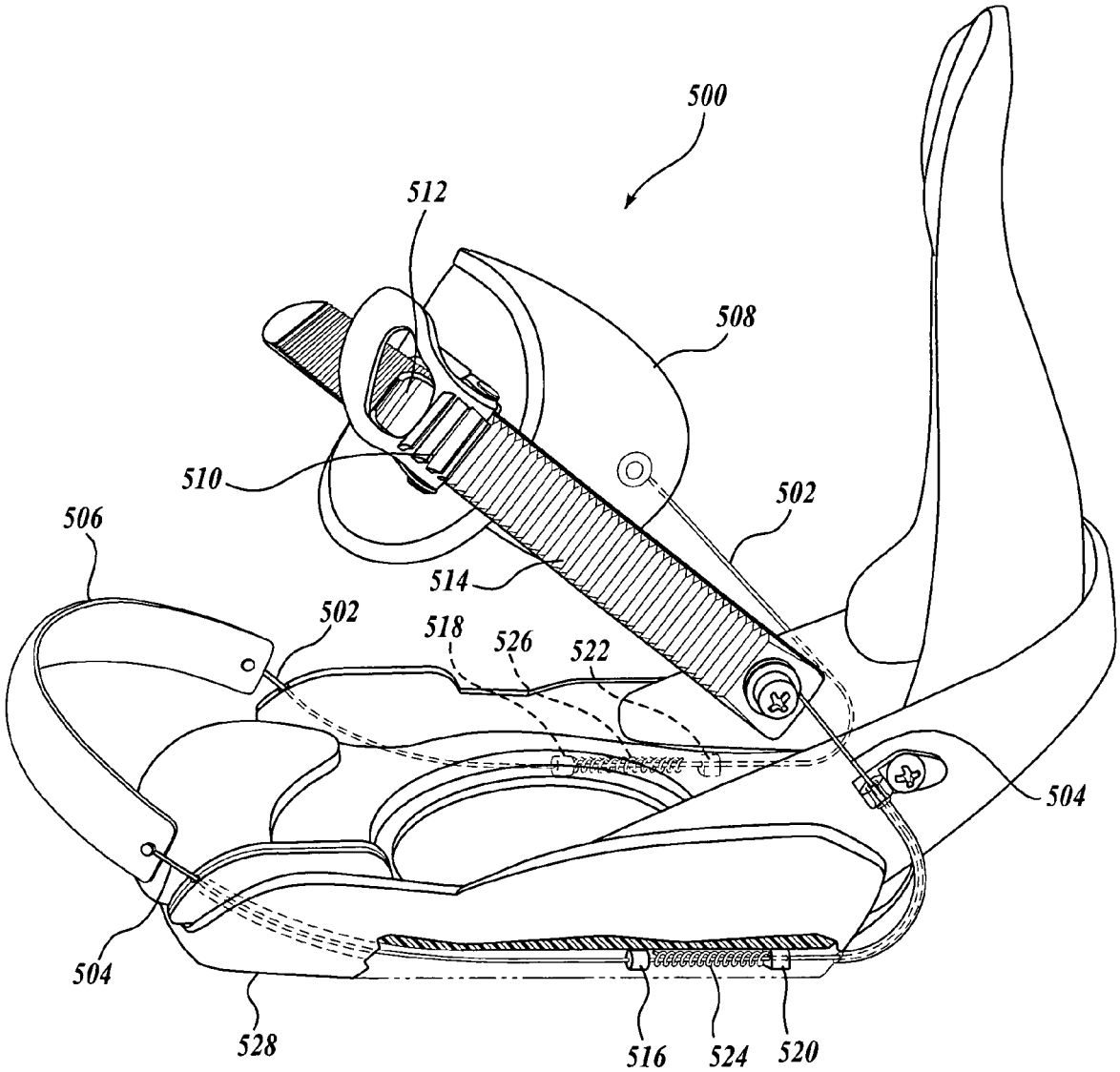
FIG. 6 is an illustration of an alternate embodiment of a binding system according to the present invention.

Referring now to FIG. 6, an alternate embodiment of a binding 500 is illustrated. In this embodiment, two cables 502 and 504, are provided. Cable 502 is connected to one end of the toe strap 506. The cable 502 is routed by baseplate guides to connect and be held fast to the ankle strap 508 on one end thereof. In this embodiment, the ankle strap fastener includes the ratchet 510, pawl 512, and strap ladder 514 described earlier. The ratchet 510 and pawl 512 components of the ankle strap fastener are mounted to the ankle strap 508 on the end of the ankle strap that is not connected to the cable 502. The cable 504 is connected to the end of the toe strap 506 that is not connected to the cable 502. The cable 504 is routed by baseplate guides to connect with the strap ladder 514. Thus, the strap ladder 514 is also indirectly connected to the baseplate 528 via the movable cable 504, and thus the strap ladder 514, in addition to the ankle strap 508, is free to travel in relation to the binding. As in the previous embodiments, operation of the ankle strap fastener takes up the slack in the cables 502, 504 connected to the toe strap 506 up to the point where the cable stop blocks 516, 518 abut against the baseplate stop features 520, 522 and prevent further travel of the cables 502, 504. Continued operation of the ankle strap fastener serves to tighten the ankle strap 508 against the instep portion of the boot while neither increasing nor decreasing the toe strap tension, thereby tightening both the toe strap 506 and the ankle strap 508 by utilizing a single strap fastener. As with previous embodiments, springs 524, 526 can be positioned between stop blocks 516, 518 on the cables 504, 502 and stop features 520, 522 on the baseplate 528 to compress during tightening of the ankle strap 508 and to assist with release of the boot from the toe strap 506, once the ankle strap fastener is disengaged.

Figure 7:
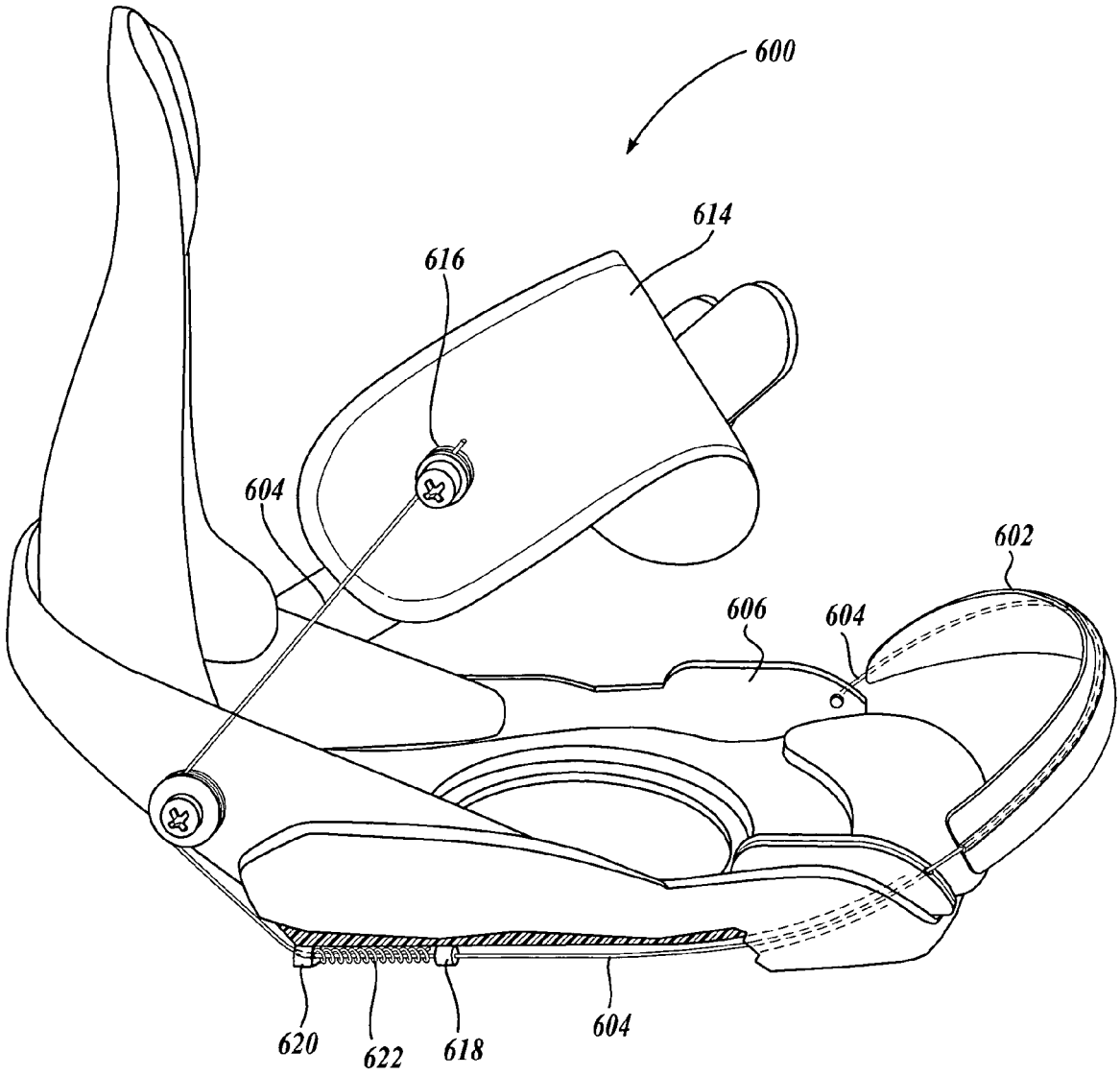
FIG. 7 is an illustration of an alternate embodiment of a binding system according to the present invention.
Figure 8:
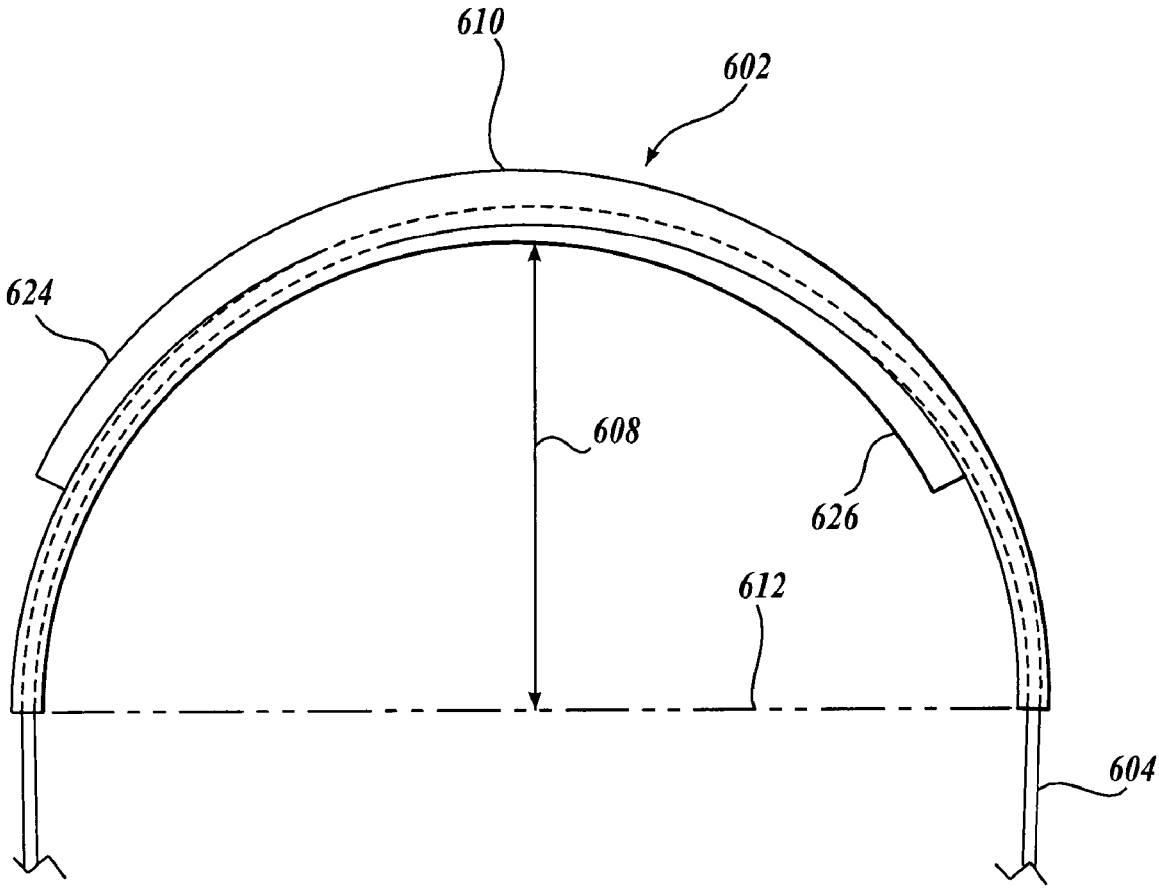
FIG. 8 is an illustration of an alternate toe strap made for the binding system of FIG. 7.

Referring now to FIGS. 7 and 8, an alternate embodiment of a binding 600 is illustrated. In this embodiment, the toe strap 602 is connected to cable 604. The toe strap 602 comprises two or more portions that may slide against one another or otherwise move in relation to each other such that the overall length from one end of the toe strap 602 to the opposite end can increase or decrease depending on whether the cable 604 is being pulled taut or is being slackened. One end of the cable 604 is held fast on a side of the front portion of the baseplate 606. As shown in FIG. 7, the path taken by cable 604 generally follows the curvature of the toe strap 602. The cable 604 is engaged with the toe strap 602 throughout the length of the toe strap 602. FIG. 8 shows the toe strap 602 from the edge, so that in its slack position, the toe strap 602 can define a height dimension 608 that is the distance of the toe strap apex 610 to a line 612 defined by the two ends of the toe strap 602. Preferably, the cable 604 is engaged to several locations on the toe strap 602, so that as the cable 604 is pulled, the height 608 of the apex 610 of the toe strap 602 is reduced by the sliding of the two portions 624, 626 of the toe strap 602, causing tightening about the toe portion of the snowboard boot. Referring back to FIG. 7, the cable 604 from the end of the toe strap 602 that is opposite to the end that is proximate to the fixed end of the cable 604 is further routed by baseplate guides and is eventually held fast to the ankle strap 614 via clamp-down nut 616. As with the other embodiments, this embodiment can have a cable stop block 618 fixed at a predetermined location on the cable 604, such that when the ankle strap fastener is operated to pull on the ankle strap 614, the cable 604 is likewise pulled, pulling the apex 610 of toe strap 602 down against the boot toe portion. The cable 604 travels a predetermined amount determined by the placement of the cable stop block 618 in relation to a stop feature 620 on the baseplate 606. As with the previous embodiments, a spring 622 can be positioned between the cable stop block 618 and the baseplate stop feature 620 to compress during tightening of the ankle strap 614 and to assist in release of the boot from the toe strap 602, once the ankle strap fastener is disengaged.

Figure 9:
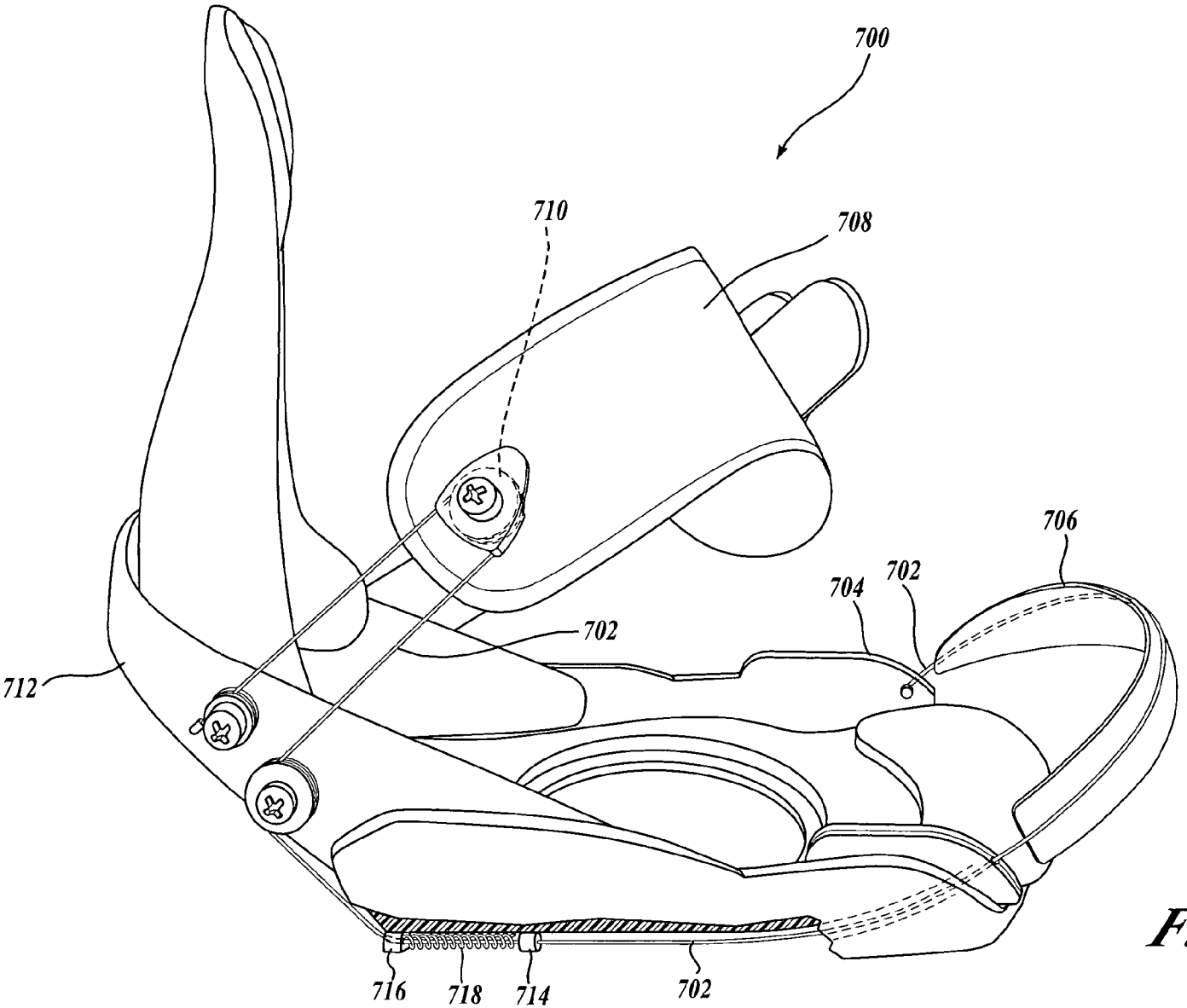
FIG. 9 is an illustration of an alternate embodiment of a boot binding system according to the present invention.

Referring now to FIG. 9, an alternate embodiment of a binding 700 according to the present invention is illustrated. In this embodiment, cable 702 is held fast to one side of the baseplate 704. The cable 702 is routed along the toe strap 706 and emerges from the toe strap 706 at the end that is opposite to the toe strap end that is proximate to the fixed end of the cable 702. The cable 702 continues to be routed by guides on the baseplate 704 to connect with the ankle strap 708. However, in this embodiment, the end of the cable 702 that is distal to the toe strap 706 is not held fast to the ankle strap 708, rather the cable 702 is attached to the ankle strap 708 via a circular guide 710, such that the cable 702 can slide along the perimeter of the circular guide 710, as in the embodiment represented by FIGS. 1 and 2. The end of the cable 702 that is distal to the end that is fixed to the front of the baseplate 704 is connected to the ankle strap 708 via the circular guide 710 and doubles back to the baseplate 704 and is finally held fast to the heel plate portion 712 of baseplate 704. The end of the cable 702 that is distal to the toe strap 706 is thus on the side that is opposite and to the rear of the fixed end of cable 702 next to the toe strap 706. It is to be appreciated from this disclosure, the effect of such cable configuration is to create a pulling system having a ratio of 2 to 1, meaning that for every unit of length that the ankle strap 708 travels, the travel distance for cable 702 is doubled. As with the previous embodiments, operation of the ankle strap fastener will cause travel of the cable 702 to a predetermined position up until cable stop block 714 held fast to the cable 702 abuts against stop feature, 716 on the baseplate 704. Thereafter, operation of the ankle strap fastener does not result in further cable travel, but causes the ankle strap 708 to tighten against the instep portion of the snowboard boot. Higher pulling ratios of 3 to 1 or 4 to 1 are possible with the addition of further guides on the baseplate and ankle strap. It is also possible to reduce the ankle strap cable pulling ratio to be less than one by having, for example, a circular guide on the toe strap with cable that doubles back to the baseplate. In this manner, for every unit of length the ankle strap travels, the travel of the toe strap is proportionately reduced. As with the previous embodiments, a spring 718 can be positioned between the stop block 714 on the cable 702 and a stop feature 716 on the baseplate 704 to compress during pulling of the ankle strap 708 and to assist in release of the boot from the toe strap 706 once the ankle strap fastener is disengaged.

The above embodiments are representative of a binding system with automated toe strap fastening upon fastening of the ankle strap. It is to be appreciated from reading this disclosure, that the toe strap can be fitted with the manual fastener, while the ankle strap tightening is automated. It should also be appreciated that the use of springs is optional in every embodiment. Springs can be located on any portion of the cable or cables leading to the toe strap, and the springs can be exterior to interior to the baseplate. The use of stop blocks adjacent to springs can serve the dual purpose to compress the spring and as cable stop blocks. Furthermore, the use of cable stop blocks and baseplate stop features to set the predetermined amount of cable travel is also optional in every embodiment. Cable travel can be halted by relying on the toe strap or the ankle strap, whatever the case may be, coming to rest about the portion of the boot the strap was meant to secure. It should also be appreciated that the manually operated fastener can be one of many fasteners. The cable end at the manually operated fastener can be attached either to the strap that is attached to the fastener, or the cable can be attached to the fastener itself. "Cable" as used herein can be one or more cable portions fastened to each other to produce a single length of cable. Furthermore, while cables may be preferred because of their strength, flexibility and cost, other type of linkages connecting the ankle strap to the toe strap in a movable fashion may be utilized.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A binding system, comprising:

a toe strap for securing the forward portion of a boot, the toe strap including a first end connected forward and on a lateral side of the binding system and a second end connected forward and on a medial side of the binding system, wherein the toe strap has at least one movable end connected to a flexible linkage to allow the end to travel;

an ankle strap for securing the instep portion of a boot, the ankle strap including a first end connected other than forward and on a lateral side of the binding system and a second end connected other than forward and on a medial side of the binding system, wherein the ankle strap has at least one movable end connected to a flexible linkage to allow the end to travel, wherein the flexible linkages connected to the movable ends of the toe and ankle straps are the same flexible linkage or different flexible linkages connected to one another; and a strap tension-producing fastener located on a first strap being one of either the toe or the ankle strap, wherein the fastener tensions the first strap on which it is located and the flexible linkages cause the other strap to be tensioned when the first strap is tensioned and when tension on the first strap is released with the fastener, tension on the other strap is released.

2. The binding system of claim 1, comprising means for setting a predetermined amount of travel for the flexible linkage upon operation of the fastener.

3. The binding system of claim 1, wherein the flexible linkages connected to the toe and ankle straps are the same first flexible linkage, and a second end of the toe strap is connected to a second flexible linkage, wherein the second flexible linkage is connected to the ankle strap on the same end of the ankle strap as the first flexible linkage.

4. The binding system of claim 1, wherein the flexible linkages connected to the toe and ankle straps are different first and second flexible linkages connected to one another, and a third flexible linkage is connected to a second side of the toe strap, wherein the first and third flexible linkages connected to the toe strap are connected to a yoke, and wherein the yoke is connected to the second flexible linkage and the second flexible linkage is connected to the ankle strap.

5. The binding system of claim 1, wherein a roller is provided to guide at least one flexible linkage to the ankle strap.

6. The binding system of claim 1, wherein the flexible linkages connected to the toe and ankle straps are the same first flexible linkage, and a second flexible linkage is connected to a second end of the toe strap, and the fastener comprises a component on a second end of the ankle strap and a component that is connected to the second flexible linkage, and wherein the fastener component on the ankle strap and the fastener component connected to the second flexible linkage are connectable to one another.

7. The binding system of claim 6 wherein the fastener comprises a ratchet, pawl, and strap ladder, wherein the ratchet and pawl are on the ankle strap and the strap ladder is connected to the second flexible linkage.

8. The binding system of claim 1, wherein the toe strap comprises at least two portions connected to one another, one end of the toe strap is held fast to the baseplate, and the length of the toe strap from end to end is adjustable by releasing the two strap portions and reconnecting the two portions at discrete positions.

9. The binding system of claim 1, wherein the flexible linkage connected to the toe strap is held fast to one side of the baseplate, the toe strap comprises at least two portions in a moving relationship, and the toe strap portions can move past one another upon travel of the flexible linkage connected to the toe strap.

10. The binding system of claim 1, wherein the flexible linkages connected to the toe and ankle straps are the same first flexible linkage, the first and second end of said first flexible linkage are held fast at first and second locations on the binding, the first flexible linkage is connected to the ankle strap at a guide, wherein the ratio of the amount of travel of the toe strap in relation to the amount of travel of the ankle strap is other than 1.

11. The binding system of claim 10, wherein the ratio of the amount of travel of the toe strap to the amount of travel of the ankle strap is greater than one.

12. The binding system of claim 10, wherein the ratio of the amount of travel of the toe strap to the amount of travel of the ankle strap is less than one.

13. The binding system of claim 10, wherein the amount of travel of the toe strap is double the amount of travel of the ankle strap.

14. The binding system of claim 1, wherein the toe strap is bifurcated into two segments, each segment is connected to a different first and second flexible linkage, the first and second flexible linkages are connected to a third flexible linkage, and the third flexible linkage is the flexible linkage connected to the ankle strap.

15. The binding system of claim 1, wherein the flexible linkage connected to the toe strap has a biasing mechanism configured to resist the travel of the flexible linkage.

16. The binding system of claim 15, wherein the biasing mechanism is a spring interposed between a stop block held fast to the flexible linkage and a stop feature on the baseplate.

17. The binding system of claim 1, wherein operation of said fastener causes travel of said flexible linkage connected to a first strap up to a predetermined position, and continued operation of said fastener further tensions the other strap, without further travel of the first strap beyond the predetermined position.

18. The binding system of claim 1, wherein operation of said fastener causes said ankle strap to travel and causes said flexible linkage connected to said toe strap to travel a proportionate ratio of the amount of travel of the ankle strap.

19. The binding system of claim 18, wherein the amount of travel of the flexible linkage connected to the toe strap is double the amount of travel of the ankle strap.

20. The binding system of claim 1, wherein travel of the ankle strap end connected to the flexible linkage causes the flexible linkage connected to the toe trap to travel.

21. The binding system of claim 1, wherein the flexible linkages comprise one or more cables.

22. The binding system of claim 1, wherein the end of the toe strap that is movable is configured to travel twice the distance compared to the end of the ankle strap that is movable.

23. The binding system of claim 1, comprising a strap ladder connected to the movable end of the ankle strap, wherein the strap ladder connects the movable end of the ankle strap to a flexible linkage.

24. The binding system of claim 1, comprising a baseplate to support the binding system, wherein the movable end of the toe strap is connected to the baseplate via a flexible linkage.

25. The binding system of claim 1, comprising a baseplate support the binding system, wherein the movable end of the ankle strap is connected to the baseplate via a strap ladder that is connected to a flexible linkage.

26. The binding system of claim 1, comprising strap tension-producing fastener that includes a ratchet and pawl located on the ankle strap and a strap ladder that connects the movable end of the ankle strap to a flexible linkage.

27. The binding system of claim 1, comprising a baseplate to support the binding system, wherein the binding system is connected to the baseplate at least at four locations.

28. The binding system of claim 1, comprising a baseplate to which the ends of the toe strap and the ankle strap are connected directly or via a flexible linkage.

29. A boot binding system, comprising:

a toe strap configured to pass over a toe portion of the boot, the toe strap including a first end connected forward and on a lateral side of the binding system and a second end connected forward and on a medial side of the binding system, said toe strap having at least one end that is movable so that the end is allowed to travel;

an ankle strap configured to pass over the instep portion of the boot, the ankle strap including a first end connected other than forward and on a lateral side of the binding system and a second end connected other than forward and on a medial side of the binding system, said ankle strap having at least one end that is movable so that the end is allowed to travel;

a strap tension-producing fastener located on a first strap being one of either the toe or the ankle strap; and a movable flexible linkage that connects the movable toe strap end to the movable ankle strap end such that the fastener tensions the first strap on which it is located and the movable flexible linkage causes the other strap to be tensioned when the first strap is tensioned and when tension on the first strap is released with the fastener, tension on the other strap is released.

30. The binding system of claim 29, wherein the movable flexible linkage comprises one or more cables.

31. A binding system for a boot comprising:

a first strap connected to a flexible linkage, the first strap including a first end connected forward and on a lateral side of the binding system and a second end connected forward and on a medial side of the binding system;

a second strap connected to the flexible linkage, the second strap including a first end connected other than forward and on a lateral side of the binding system and a second end connected other than forward and on a medial side of the binding system; and a strap tension-producing fastener located on one of either the first or the second strap, wherein operation of said fastener tensions the strap on which it is located and the flexible linkage causes the other strap to be tensioned when the first strap is tensioned and when tension on the first strap is released with the fastener, tension on the other strap is released.

32. The binding system of claim 31, wherein the flexible linkage comprises one or more cables.

33. A snowboard boot binding system, comprising:

a baseplate;

a toe strap for securing the toe portion of a boot to the baseplate, wherein the toe strap has a first end and a second end;

an ankle strap for securing the instep portion of a boot to the baseplate, wherein the ankle strap has a first end and a second end;

a first linkage attached to the first end of the toe strap, the linkage being guided along the baseplate to the first end of the ankle strap;

a second linkage attached to the second end of the toe strap, the linkage being guided along the baseplate to the first end of the ankle strap; and an ankle strap fastener for fastening the second end of the ankle strap to the baseplate in an adjustable manner, wherein operation of the ankle strap fastener to tension the ankle strap also tensions the first and the second linkage, which tension both ends of the toe strap.

34. The snowboard boot binding system of claim 33, wherein the first linkage has a spring between a stop feature on the base plate and the end of the toe strap.

35. The snowboard boot binding system of claim 33, wherein the second linkage has a spring between a stop feature on the base plate and the end of the toe strap.

36. The binding system of claim 33, wherein the linkages comprise one or more cables.

37. A binding system comprising:

a baseplate to support the binding system;

a toe strap for securing the forward portion of a boot, the toe strap including a first end and a second end, wherein the toe strap has at least one movable end connected to a flexible linkage to allow the end to travel;

an ankle strap for securing the instep portion of a boot, the ankle strap including a first end and a second end, wherein the ankle strap has at least one movable end connected to a flexible linkage to allow the end to travel, wherein the flexible linkages connected to the movable end of the toe and ankle straps are the same flexible linkage or different flexible linkages connected to one another;

a strap tension-producing fastener located on a first strap being one of either the toe or the ankle strap, wherein the fastener tensions the first strap on which it is located and the flexible linkages cause the other strap to be tensioned when the first strap is tensioned, and when tension on the first strap is released with the fastener, tension on the other strap is released; and wherein the binding system is connected to the baseplate at least at four locations via the ends of the toe strap and ankle strap.

38. The binding system of claim 37, wherein one end of each of the toe and ankle strap is connected at the lateral side of the baseplate and one end of each of the toe and ankle straps is enclosed at the medial side of the baseplate.

* * * * *

UNITED STATES PATENT AND TRADEMARK OFFICE

CERTIFICATE OF CORRECTION

PATENT NO. : 7,568,719 B2
APPLICATION NO. : 10/714510
DATED : August 4, 2009
INVENTOR(S) : T. M. Sauter It is certified that error appears in the above-identified patent and that said Letters Patent is hereby corrected as shown below:

| COLUMN | LINE | ERROR |
|---|---|---|
| 13 (Claim 7, | 15 line 1) | after "claim 6" insert --,-- |
| 13 (Claim 7, | 17 line 3) | after "ankle strap" insert --,-- |
| 14 (Claim 20, | 8 line 3) | "trap" should read --strap-- |
| 14 (Claim 25, | 22 line 1) | after "baseplate" insert --to-- |
| 14 (Claim 26, | 26 line 1) | after "comprising" insert --a-- |
| 14 (Claim 31, | 61 line 1) | after "boot" insert --,-- |
| 16 (Claim 38, | 31 line 2) | "strap" should read --straps-- |

Signed and Sealed this

Twenty-second Day of December, 2009

David J. Kappos

David J. Kappos
*Director of the United States Patent and Trademark Office*